United States Patent [19]

Apri

[11] 4,324,025

[45] Apr. 13, 1982

[54] CLAMP

[76] Inventor: Edward W. Apri, 998 Lehigh St., Altadena, Calif. 91001

[21] Appl. No.: 122,150

[22] Filed: Feb. 19, 1980

[51] Int. Cl.[3] ..... B42F 1/02; A44B 21/00

[52] U.S. Cl. ..... 24/261 R; 24/261 C; 24/139; 24/67.9

[58] Field of Search ..... 24/261 R, 261 C, 139, 24/67 R, 67.3, 67.5, 67.9

[56] References Cited

U.S. PATENT DOCUMENTS

| | | | |
|---|---|---|---|
| 1,150,229 | 8/1915 | Schuch | 24/261R |
| 1,176,210 | 3/1916 | Farley | 24/261 R |
| 1,346,608 | 7/1920 | Pratt | 24/261 R |
| 1,413,341 | 4/1922 | Lokometzki | 24/261 R |
| 1,469,623 | 10/1923 | Colombani | 24/261 C |
| 1,478,530 | 12/1923 | Rooney | 24/261 R |
| 3,333,307 | 8/1967 | Wheeler | 24/261 C |
| 3,530,545 | 9/1970 | Lengyel | 24/261 C |

FOREIGN PATENT DOCUMENTS

| | | | |
|---|---|---|---|
| 1117620 | 5/1956 | France | 24/261 R |
| 481963 | 3/1938 | United Kingdom | 24/261 R |

*Primary Examiner*—Victor N. Sakran

*Attorney, Agent, or Firm*—Wm. Jacquet Gribble

[57] ABSTRACT

A spring steel wire is bent to have an open head from which criss-crossing limbs extend to form separated limbs each with two bearing points for gripping an object to be clamped. Preferably each limb is a tilted "L" which is normally crossed twice over the other limb. The head defines a hand or finger grip such that when the extremes of the separated limbs are placed in contact with a work to be clamped, the head affords a grip by which the entire clamp may be twisted with respect to the work and then pushed further onto the work such that the grip of the clamp on the work is increased because of the forces resulting from the re-orientation of the cross-over limbs.

4 Claims, 11 Drawing Figures

T
W

CLAMP

BACKGROUND OF THE INVENTION

The invention relates to clamps or clips for grasping relatively thin, substantially planar, objects such as wooden plaques, thin metal plates or sheafs of paper, and more particularly to light weight clamps capable of bearing several times their weight by the clamping force exerted. The clamps of the invention differ from conventional clip board clamps and oversized paper clips in being capable of securely gripping a proportionately greater mass for their weight.

SUMMARY OF THE INVENTION

The invention contemplates a bent wire clamp having a finger grip or head portion which may be of various configurations from which clamping limbs extend, each limb crossing over the other limb and then diverging from that limb in substantially the same plane. Preferably the limbs and head are also substantially co-planar, but need not always be so. The free ends of the limbs may be footed. The feet may take the form of articulated, rolling segments, open loops or a resilient overlay, all of which act as pressure points. At or near the cross-over point of the two limbs each limb has a second pressure, or gripping, point. In a preferred embodiment a limb crosses the other limb twice and the second pressure point is intermediate the cross-over points.

An alternate embodiment configuration which is not entirely co-planar is one in which the clamp of the invention is used to hang a thick load, in which case a central portion of the head is offset from the plane of the limbs such that the limbs, which are separated by the thickness of the load, are connected by the offset portion which can remain parallel to the long axis of the load.

The clamp of the invention is easily made on existing wire bending equipment and can be made from commercially available spring steel wire. The head may be configured either artistically or functionally to fit the intended use and any single clamp accommodates to a large variety of load thicknesses.

These and other advantages of the invention are apparent from the following detailed description and drawing.

BRIEF DESCRIPTION OF THE DRAWING

In the various Figures like parts are identified by like numerals.

DESCRIPTION OF THE PREFERRED EMBODIMENTS

Figures 1, 2, 3, 4, 5, 6, 7, 8, 9, 10, 11:
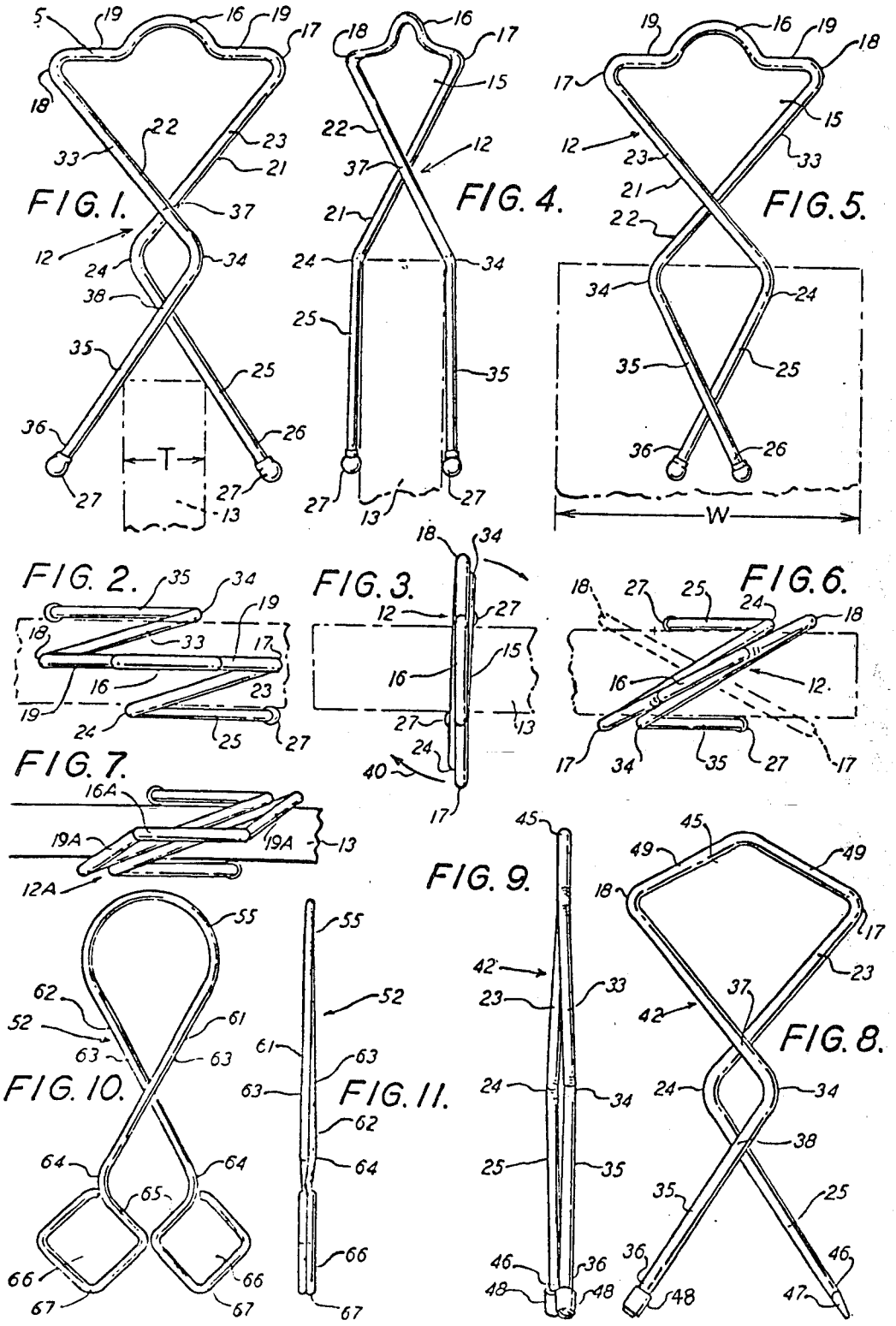
FIG. 1 is a front elevation of a clamp in accordance with the invention placed transversely of a work load.
FIG. 2 is a plan view of the clamp of FIG. 1 twisted longitudinally out of the position of FIG. 1.
FIG. 3 is a plan view of the progression of the clamp of FIG. 1 being twisted for maximum clamping force.
FIG. 4 is and end elevation of the clamp in clamping position.
FIG. 5 is a front elevation of the clamp in clamping position.
FIG. 6 is a plan view of the clamp of FIG. 5.
FIG. 7 is a plan view of an alternate embodiment cf the clamp of the invention.
FIG. 8 is a front elevation of a further alternate embodiment.
FIG. 9 is an end elevation of the clamp of FIG. 8.
FIG. 10 is a front elevation of a further alternate embodiment of the invention.
FIG. 11 is an end elevation of the clamp of FIG. 10.

FIGS. 1 through 6 illustrate a clamp 12 in accordance with the invention in its various attitudes with respect to a load 13. The load has a thickness "T" which may vary from use to use of the clamp. The width "W" of the load 13 is representative only.

In FIG. 1 clamp 12 is seen to have a grip loop or head 15 which is grasped to apply the clamp to the load. The head also has a hanger segment 16, which in the embodiment of FIG. 1 is an arcuate portion between horizontally spaced arcuate elbows 17, 18. Straight portions 19 may extend between each elbow and the hanger segment 16.

Each elbow has extending therefrom a gripping limb. From elbow 17 extends a generally "L" shaped limb 21, while from elbow 18 extends a a generally "L" shaped limb 22. Limb 21 has an upper shank 23 extending to an arcuate knee 24 which connects between upper shank 23 and a lower shank 25. A foot 26 of limb 21 has a resilient cap 27 which affords protection against abrasion to the load which is gripped.

Similarly, limb 22 has an upper shank 33 which extends at an angle from elbow 18 to an arcuate knee 34 which connects the upper shank to a lower shank 35 which terminates in a foot 36. The foot has a spherical cap 27. As can be seen from FIG. 1, limb 22 crosses over limb 21 at two points: 37 and 38. The crossover points are on either side of the knees 24, 34. Both the feet 26, 36 and the knees 24, 34 define bearing points which grip the load when the clamp is applied to the load.

In FIG. 2 the clamp has been turned with respect to the load and thrust downwardly thereon so that the lower shanks 25, 35 and knees 24, 34 are in contact with the faces of the load and apply a certain amount a gripping pressure thereto. This position is shown in plan view in FIG. 2 and it can be seen that hanger segment 16 is generally parallel to the extent of the load 13. In FIG. 3 clamp 12 is turned by means of head 15 in the direction of the arrows 40 to torque the clamp and impose a greater gripping force on the load. At the end of the twist the clamp assumes the attitude of FIG. 4 wherein first crossover point 37 becomes a thrust point of one limb against the other. The resultant is transmitted to the lower shank and the knees to impose a greater gripping force upon the load.

In FIG. 5 the clamped position of the limbs is shown, with the load 13 shown in broken lines so that the shift of the crossover point 38 is now apparent. Also, the reversal of the limb crossover is shown, illustrating how the ultimate clamping pressure is caused to be imposed upon the clamp.

As is indicated in FIG. 6 by the broken lines 41, the attitude of the head 15 has been reversed with respect to the longitudinal axis of load 13, which is the factor whereby the gripping load is increased.

In the embodiment of FIG. 7 a clamp 12A is similar to clamp 12 of FIG. 1 except for the relative attitude of a hanger segment 16A and separated straight portions 19A. A comparison of FIGS. 6 and 7 shows that the hanger segment 16A is not in the same plane with the straight portions 19A and can thereby be largely parallel to the longitudinal extent of load 13 for a better hanging attitude with respect to a wall surface (not shown), for instance, which may be parallel to load 13.

FIGS. 8 and 9 illustrate an embodiment of the invention in which a clamp 42 differs from the clamp of FIG. 1 in having a head 45 comprised of two straight portions 49 defining an obtuse angle as a hanging segment midway between elbows 17 and 18. Limbs 21 and 22 extend from the elbows to feet 46 and 36, respectively. Foot 46 is beveled in a point 47. Foot 36 is sheathed in an articulated roller sleeve 48. It is unlikely that any one clamp would have differing feet, as shown, but would rather have like feet, of either type, as shown in FIG. 9, where both feet are sleeved.

FIGS. 10 and 11 illustrate an embodiment of the invention having gripping limbs that crisscross at one point only, while still having two points of pressure on each limb. A clamp 52 has a semicircular head 55 which encompasses the functions of the elbows, hanging segment and straight portions of the previously described embodiments. Each limb 61, 62 has an upper shank 63 and a lower shank 65 joined by an arcuate knee 64. Each lower shank 65 defines one side of a hollow diamond 66 which in turn functions as a limb foot, with the extreme apex 67 of each diamond being the second point of pressure of each limb.

Because of the single cross-over point of its limbs, the clamp 52 of FIG. 10 is not capable of twisting about a central axis on the load for maximizing torque to apply multiplied gripping force. However, because of the cross-over principle and the separated point of pressure on each clamp limb, the embodiment of FIG. 10 has proved to be surprisingly efficient as a clamp. For instance, a clamp of 0.050" diameter wire has been found to support a static load of 1.5 pounds, while itself weighing only In similar tests the clamps of the type shown in FIGS. 1–9 have been shown to support a static load of 21 pounds when formed from 0.190" diameter wire and weighing only The clamp of the invention, therefore, is demonstrably superior in efficiency to known wire or spring-loaded clamps and is easily made by conventional means of conventional materials obtainable through ordinary trade channels. While several embodiments of the invention have been shown, other variations which are within the scope of the invention will occur to those skilled in this particular art. It is therefore desired that the scope of the invention be measured by the appended claims rather than by the foregoing illustrative disclosure.

I claim:

1. A wire clamp comprising a head, a hanging segment on the head, L-shaped limbs extending from the head at each side thereof, said limbs having upper straight shanks crossing one another, and lower straight shanks crossing one another, said crossings being in substantially the plane of the head, a pressure elbow defined at the juncture of the upper and lower shank of each limb, and a pressure foot on each lower shank, each of said lower shanks being substantially straight throughout its entire length from elbow to pressure foot, and said lower shanks further diverging one from the other away from said elbows.

2. A wire clamp in accordance with claim 1 wherein each shank is a single wire strand where said shank crosses the other shank.

3. A wire clamp in accordance with claim 1 wherein the crossovers of the upper and the lower shanks occur on the same side of the other limb such that the limbs may be separated from head to foot to receive a load.

4. A wire clamp in accordance with claim 1 wherein the pressure foot is a wire loop integral with the lower shank of each limb.

* * * * *